United States Patent [19]

Zimmerman

[11] 4,048,279

[45] Sept. 13, 1977

[54] WASHING PROCESS FOR INORGANIC ACID CONTAINING POLYAMIDE FIBERS

[75] Inventor: Joseph Zimmerman, Wilmington, Del.

[73] Assignee: E. I. Du Pont de Nemours and Company, Wilmington, Del.

[21] Appl. No.: 590,373

[22] Filed: June 25, 1975

[51] Int. Cl.[2] ..... D01F 6/00; B08B 3/00

[52] U.S. Cl. ..... 264/184; 8/137; 260/78 A; 260/78 S; 264/233

[58] Field of Search ..... 264/184, 233; 8/137; 260/78 A, 78 R, 78 S

[56] References Cited

U.S. PATENT DOCUMENTS

| | | | |
|---|---|---|---|
| 3,767,756 | 10/1973 | Blades | 264/184 |
| 3,869,429 | 3/1975 | Blades | 264/184 |
| 3,886,251 | 5/1975 | Sekiguchi et al. | 264/184 |
| 3,888,821 | 6/1975 | Milford | 264/182 |

*Primary Examiner*—Jay H. Woo

[57] ABSTRACT

An improved neutralization process for use in the high speed spinning of an inorganic acid-containing polyamide spin dope.

3 Claims, 1 Drawing Figure

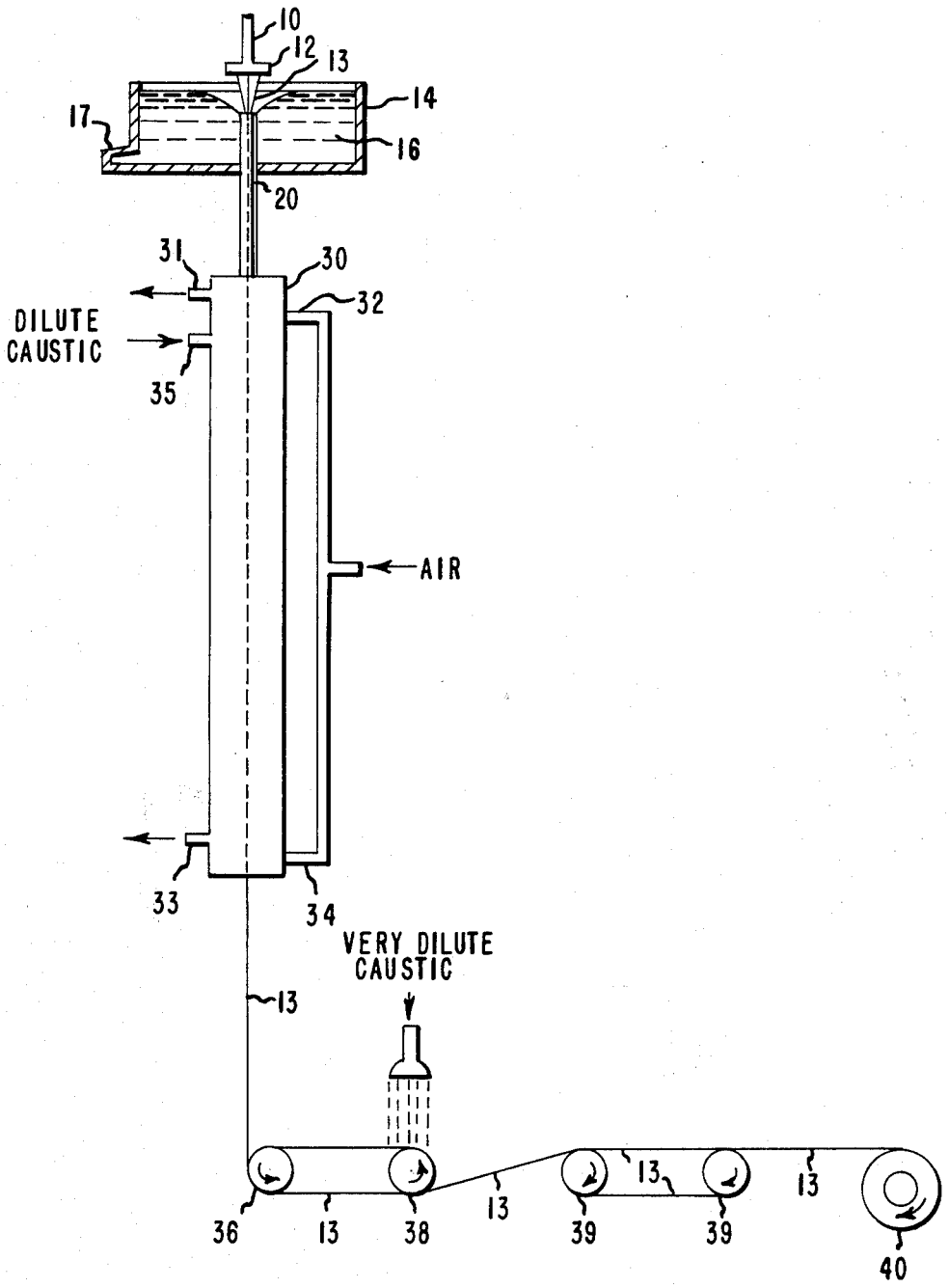
10
12
13
14
17
16
20
31
30
32
DILUTE
CAUSTIC
35
AIR
33
34
VERY DILUTE
CAUSTIC
13
36
13
38
13
39
13
39
13
40

WASHING PROCESS FOR INORGANIC ACID CONTAINING POLYAMIDE FIBERS

BACKGROUND OF THE INVENTION

Certain prior art has dealt with the neutralization of inorganic acid-containing fibers. Thus, in U.S. Pat. No. 3,817,941, Example 6, bobbins of poly(p-phenylene terephthalamide) are soaked in water for a few hours, in dilute sodium carbonate solution overnight and in running water for a few hours before being dried. In U.S. Pat. No. 3,767,756, Example IIA, a windup bobbin of poly(p-phenylene terephthalamide) is sprayed with water, stored in water and then submerged in 0.1N $NaHCO_3$, and extracted with water on the reel device before windup and drying. U.S. Pat. No. 3,869,429 suggests (at col. 9, lines 25–48) spraying the threadline with 0.05N NaOH, washing with water, windup on bobbins, storing the bobbins in water or dilute alkaline solution for up to 24 hours and then washing with water. Variations are also taught. These patents teach the need for complete removal of acid but are not addressed to the difficulties involved in a high speed continuous spinning operation wherein neutralization must take place in a small area and in a matter of seconds due to time and space limitations.

SUMMARY OF THE INVENTION

This invention provides a novel process for the neutralization of inorganic acid-containing polyamide filaments, firt with a caustic solution having a concentration of 0.3 to 1.3% and then with a caustic solution having a concentration of 0.01 to 0.1%. The filaments that are treated have been formed by extrusion of an inorganic acid-containing spin dope through a plurality of orifices, coagulation in an aqueous bath and optionally washing the resulting filaments with water to reduce the acid content. The present invention achieves complete neutralization of the acid content as well as effective removal of the salt which forms on neutralization.

DRAWINGS

FIG. 1 is a schematic view of an apparatus arrangement suitable for use in performing the invention.

DETAILED DESCRIPTION OF THE INVENTION

This invention relates to improvements in the high speed continuous process of spinning polyamide yarns from inorganic acid-containing spin dopes. In such processes the dope is extruded through orifices, coagulated in an aqueous bath, the resulting yarn is removed from the bath, stripped of entrained liquid (and optionally, washed with water) and then neutralized with caustic, dried and wound up in a yarn package. Prior to neutralization, the yarns are acidic, generally containing about 0.3 to 2% by weight of acid on a dry yarn basis. Because of difficulties in process control, the yarns are often found to be acidic or too basic with the result that they exhibit inferior heat aged strength retention (HASR), that is, the breaking strength of the yarn diminishes excessively after it has been exposed to elevated temperatures.

In the high speed continuous process described above, it is often not practical to provide sufficient time to completely neutralize yarn on the process equipment. Attempts to water wash the yarns after application of the caustic results in an acidic yarn being produced if the wash rate is too great, probably because the caustic has not had an opportunity to completely neutralize the yarn before the caustic is washed away. On the other hand, too low a wash rate often results in a too basic yarn. Sensitivity to the water wash rate is particularly acute when using low caustic concentrations (0.3 to 1.3%) in the initial neutralization stage, such as are desired to reduce the level of salt formed in the yarn on neutralization. The application of a very dilute caustic wash (0.01 to 0.1%) to treat the yarn which has previously been treated with dilute caustic produces a neutral or very slightly basic yarn over a broader range of wash flow rates for the final neutralization step.

The apparatus of FIG. 1 is similar to that used in the spinning process of Blades U.S. Pat. No. 3,767,756 and includes as general components thereof a transfer line 10 through which is pumped spinning dope to a spinning block 12 located above the vessel 14 containing a liquid coagulating bath 16 supplied from pipe 17. A spin tube 20 immersed in the bath 16, extends through vessel 14 and connects to the extraction and washing apparatus generaly designated as 30. Extruded filaments 13 are forwarded through coagulating liquid 16 that is flowing from vessel 14 through tube 20 into extraction washing apparatus 30. Entrained liquid is removed via drain pipe 31 with the assistance of air supplied through pipe 32. The filaments are then subjected to a two-step neutralization process. First they are treated with dilute caustic supplied through pipe 35 and liquid is removed via drain pipe 33 with the assistance of air supplied through pipe 34. The filaments are withdrawn from extraction wash apparatus 30 by driven roll 36 and its associated separator roll 38 and are then again treated with very dilute caustic while on roll 38. The filaments then pass to driven steam heated rolls 39 where they are dried to 10 to 25% moisture based on dry yarn and then to windup on roll 40. As a variation of the foregoing, the filaments after being separated from entrained coagulating liquid are washed with water prior to the first treatment with caustic.

TEST PROCEDURES

Heat-aged Strength Retention (HASR)

Dry yarn is wound by hand around an aluminum plate. The plate is placed in an air circulating oven at 240° C and heated for 3 hours at that temperature and cooled. The plate with yarn is conditioned for 2 hours at 75° F (23.9° C), 55% relative humidity and the yarn is removed from the plate. The heated yarn and the original yarn (similarly conditioned) are each twisted to 3 turns per inch (per 2.5 cm) and broken with a 10 inch (25.4 cm) gauge on an Instron testing machine.

HASR is calculated from the equation:

$$HASR = \frac{\text{break strength heated yarn}}{\text{break strength original yarn}} \times 100$$

Inherent Viscosity (I.V.) is defined by the equation:

$$\text{I.V.} = 1n\,(\eta\text{rel})/c$$

where $c$ is the concentration (0.5 gram of polymer in 100 ml of 95–98% $H_2SO_4$) of the polymer solution and $\eta$rel (relative viscosity) is the ratio between the flow times of the polymer solution and the solvent as measured at 30° C in a capillary viscometer.

Acid or Base Content

A 2–3 gram sample of dried yarn is placed in 250 ml of water and heated to boiling with stirring for 10 minutes. The aqueous extract is titrated potentiometrically with a standard solution of NaOH or HCl. The extracted fiber is dried and weighed. The acid or base content (equivalents/$10^6$ grams of dry fiber) is calculated from the titration after correction with a titration on a blank sample of water similarly heated.

The following examples illustrate the surprising results achieved by the process of the invention.

EXAMPLE 1

A spinning solution of 19.5% of poly(p-phenylene terephthalamide) of I.V. 5.8 in 100.1% sulfuric acid is extruded from a spinneret containing 1000 holes through an 0.25 inch (6.4 mm) layer of air into water. The coagulated filaments are carried through the water for about 0.3 second before the liquid is removed by air jets. The yarn of filaments (containing about 1% $H_2SO_4$ on a dry yarn basis) is then impinged with streams of dilute aqueous caustic (NaOH) (50° C.) and the yarn advanced in contact with the caustic in a tube for about 0.8 second before the liquid is removed by air jets. The yarn is then sprayed with water or very dilute aqueous caustic (50° C.) for a final wash while passing from a driven feed roll to an idler roll with 12 wraps for a total residence time of about 1 second. The yarn is then passed to drying rolls and to a package. Apparatus similar to FIG. 1 is used. A. In this comparative example the above procedure is followed with the dilute aqueous caustic concentration ranging from 0.6 to 0.7% and the flow rate of the water spray is varied. Properties of the dried 1500 denier yarn collected at 600 yards (549 m) per minute are given in Table I as items *a–d.* B. The above general procedure is followed using a dilute aqueous caustic solution of 0.6% and varying the flow rate of the final wash with very dilute caustic (0.02–0.05% NaOH). Properties of the dried 1500 denier yarn collected at 500 yards (472 m) per minute are given in Table I as items *e–h.*

The acid/base analyses of dried yarns are obtained from other spins with about the same conditions. It is noted that without the final wash (items *a* and *e*) a basic yarn is obtained with a low HASR value. High wash rates (items *c* and *d*) are found to yield an acidic yarn with low HASR values. It is seen that the use of water alone makes the process extemely sensitive to wash flow rate.

The use of very dilute caustic gives an extended range of acceptable flow rates (items *f* and *g*) that affords an easier control of the process.

Similar yarn with an HASR of 82% is obtained using 0.4% caustic as the first neutralization followed by 0.03% caustic at a flow rate of 1.4 gallons (5.3l) per minute, drying and winding up at 600 yards (549 m) per minute.

EXAMPLE 2

A spinning solution of about 18.8% of poly(p-phenylene terephthalamide) of I.V. 5.4 in 100.1% sulfuric acid is extruded from a spinneret containing 1000 holes through an 0.25 inch (6.4 mm) layer of air into a 3% aqueous solution of $H_2SO_4$. The yarn of coagulated filaments is quickly removed from the initial liquid and washed on rolls. The yarn is washed with water (25° C.) for about 4.7 seconds and the yarn (containing about 0.5% $H_2SO_4$ on a dry yarn basis) is then sprayed with a dilute aqueous caustic solution (25° C.) (0.5% NaOH) for about 3.2 seconds while passing over rolls and finally sprayed with a very dilute caustic solution (0.02% NaOH) for a period of about 1.5 seconds while passing over rolls before being dried and wound up at 665 yards (608 meters) per minute.

Typical yarns have a HASR value of about 83–85%. Similar results are obtained using a final wash containing from 0.01 to 0.07% NaOH.

TABLE I

| | | | | Dried Yarn Properties | | |
|---|---|---|---|---|---|---|
| Item | Wash Liquid | Final Wash Rate gallons/minute (liters/minute) | | HASR % | Acid or Base Content equiv./$10^6$gram | |
| a | None | 0 | | 41 | 72 | base |
| b | Water | 0.25 | (0.95) | 78 | 4.5 | base |
| c | Water | 0.5 | (1.89) | 75 | | acid |
| d | Water | 1.5 | (5.68) | 69 | | acid |
| e | None | 0 | | 40 | 72 | base |
| f | Very dilute caustic | 0.5 | (1.89) | 80 | | |
| g | " | 1.5 | (5.68) | 82 | 5.7 | base |
| h | " | 2.5 | (0.46) | 74 | 1.8 | acid |

I claim:

1. Process for the continuous high-speed production of neutral to very slightly basic polyamide yarn comprising in sequence 1. extrusion of an inorganic acid containing spin dope through a plurality of orifices,
2. coagulation of the yarn in an aqueous bath,
3. stripping of entrained liquid,
4. treating the yarn with a caustic solution having a concentration of 0.3 to 1.3%,
5. stripping the liquid from the yarn,
6. treating the yarn with a caustic solution having a concentration of 0.01 to 0.1%,
7. drying the yarn and
8. winding the yarn in a package.

2. The process of claim 1 wherein the acid content of the yarn prior to neutralization is about 0.3 to 2% by weight based on the dry yarn.

3. The process of claim 1 wherein the spin dope consists essentially of poly(p-phenylene terephthalamide) and sulfuric acid.

* * * * *